US007357885B2

(12) United States Patent
Yasuda

(10) Patent No.: US 7,357,885 B2
(45) Date of Patent: Apr. 15, 2008

(54) TRANSPARENT CONDUCTIVE MATERIAL AND TRANSPARENT CONDUCTIVE MEMBER

(75) Inventor: Noriyuki Yasuda, Tokyo (JP)

(73) Assignee: TDK Corporation, Tokyo (JP)

( * ) Notice: Subject to any disclaimer, the term of this patent is extended or adjusted under 35 U.S.C. 154(b) by 65 days.

(21) Appl. No.: 11/230,524

(22) Filed: Sep. 21, 2005

(65) Prior Publication Data

US 2006/0060828 A1 Mar. 23, 2006

(30) Foreign Application Priority Data

Sep. 22, 2004 (JP) ..... P2004-275717

(51) Int. Cl.
*H01B 1/12* (2006.01)

(52) U.S. Cl. ..... 252/519.3; 252/519.33

(58) Field of Classification Search ..... 252/500, 252/519.3, 519.33
See application file for complete search history.

(56) References Cited

U.S. PATENT DOCUMENTS 4,911,864 A * 3/1990 Sato et al. ..... 252/519.31
6,905,637 B2 * 6/2005 Yeager et al. ..... 252/511
7,122,253 B2 * 10/2006 Yamaguchi et al. ..... 428/447
2006/0157675 A1 * 7/2006 Hasskerl et al. ..... 252/500

FOREIGN PATENT DOCUMENTS

| | | | |
|---|---|---|---|
| JP | A 08-078164 | | 3/1996 |
| JP | A 11-058598 | | 3/1999 |
| JP | A 11-273874 | | 10/1999 |
| JP | A-2001-270999 | | 10/2001 |
| JP | 2002-160330 | * | 6/2002 |

* cited by examiner

*Primary Examiner*—Mark Kopec
*Assistant Examiner*—Jaison Thomas
(74) *Attorney, Agent, or Firm*—Oliff & Berridge, PLC

(57) ABSTRACT

The present invention provides a transparent conductive material containing a conductive powder, a reactive compound having an organic group capable of being bound to the conductive powder, and reactive functional groups; and a multifunctional organic compound capable of being bound to the reactive compound.

14 Claims, 2 Drawing Sheets

TRANSPARENT CONDUCTIVE MATERIAL AND TRANSPARENT CONDUCTIVE MEMBER

BACKGROUND OF THE INVENTION

1. Field of the Invention

The present invention relates to a transparent conductive material and a transparent conductive member.

2. Related Background Art

Transparent electrodes are used in LCDs, PDPs, organic EL displays, touch panels, etc. and transparent conductive members are used as the transparent electrodes. The transparent conductive members are made of transparent conductive oxide materials, and it is conventionally known that such transparent conductive oxide materials include metal oxides such as tin oxide, indium-tin complex oxide, indium oxide, zinc oxide, and zinc-antimony complex oxide.

These transparent conductive member are normally made in a film form by sputtering and, however, they have some problems: e.g., equipment is expensive; efficiency of film formation is low; the film is easy to crack, and so on. On the other hand, there are also studies on the transparent conductive members based on complex structure of conductive powder made of the aforementioned transparent conductive oxide materials, with resin or the like, and the complex transparent conductive members are characterized by excellent flexibility and crack-resistant structure.

However, if the complex transparent conductive members are used in a high humidity environment, the complex transparent conductive members will gradually absorb water to increase the electric resistance of the transparent conductive members themselves, and tend to increase temporal change of the electric resistance.

For this reason, if the transparent conductive members are used, for example, in a touch panel or the like and kept in a high humidity environment, the operation of the touch panel could become unstable little by little.

There are thus desires for a transparent conductive material capable of suppressing the increase and temporal change of electric resistance due to absorption of water. For example, optically transparent conductive materials proposed heretofore include those using a phenoxy resin believed to have low moisture absorption, or a mixed resin of the phenoxy resin with an epoxy resin, or polyvinylidene fluoride as a resin for fixing the conductive powder (see e.g., Japanese Patent Application Laid-Open No. 08-78164 and Japanese Patent Application Laid-Open No. 11-273874 below).

SUMMARY OF THE INVENTION

In recent years, however, there are demands for a transparent conductive member with smaller change of electric resistance even in a high humidity environment, in order to seek higher reliability of the transparent conductive member.

The present invention has been accomplished under the above circumstances, and an object of the invention is to provide a transparent conductive material and a transparent conductive member capable of adequately suppressing the increase and temporal change of electric resistance in the transparent conductive member even in a high humidity environment.

The Inventors conducted elaborate research in order to solve the above problem, and discovered that the resistance sometimes increased in long-term use in the high humidity environment even in the case where the resin believed to have low moisture absorption, described in the above Japanese Patent Application Laid-Open No. 08-78164 and Japanese Patent Application Laid-Open No. 11-273874, was used. Therefore, the resins in the above documents failed to completely solve the aforementioned problem, and the Inventors presumed that the increase and temporal change of electric resistance in the transparent conductive member could be caused by disconnection of junctions between particles of the conductive powder. Namely, where water is attached to the transparent conductive member, it is recognized that the transparent conductive member containing this conductive powder tends to swell. Therefore, the Inventors presumed that water diffused into the resin or the like to cause swelling of the resin or the like and this resulted in disjunction of particles of the conductive powder, so as to cause the increase and temporal change of electric resistance of the transparent conductive member. Then the Inventors conducted further elaborate research on the basis of the foregoing presumption and found that the aforementioned problem could be solved by the invention below, thereby accomplishing the present invention.

Namely, a transparent conductive material of the present invention is a transparent conductive material comprising: a conductive powder, a reactive compound having an organic group capable of being bound to the conductive powder and a plurality of reactive functional groups; and a multifunctional organic compound capable of being bound to the reactive compound.

With this transparent conductive material, the conductive powder; the reactive compound, and the multifunctional organic compound are reacted so that the conductive powder is bound to the organic group and so that the reactive compound is bound to the multifunctional organic compound, whereby it becomes feasible to obtain a crosslinked polymer through binding between the reactive compound and the multifunctional organic compound and to firmly bind the conductive powder to the crosslinked polymer. For this reason, it becomes feasible to obtain a transparent conductive member capable of adequately suppressing the increase and temporal change of electric resistance even if placed in a high humidity environment.

A mechanism enabling the adequate suppression of the increase and temporal change of electric resistance in the transparent conductive member as described above is still incompletely understood, but the Inventors believe that in the transparent conductive member containing the conductive powder and the crosslinked polymer, the crosslinked polymer fills spaces between particles of the conductive powder scattered in the transparent conductive member and that even if it is placed in the high humidity environment, the swelling of the crosslinked polymer is fully prevented, so as to adequately prevent the disjunction between particles of the conductive powder and to result in adequately suppressing the increase and temporal change of electric resistance of the transparent conductive member.

In addition, if a conductive powder having organic groups on its surface is reacted with a reactive compound and a multifunctional organic compound having no organic group, the initial resistance tends to be high because a dielectric layer is preliminarily formed on the surface of the conductive powder. Furthermore, there remain many free organic groups not reacting with the reactive compound, on the surface of the conductive powder to degrade adhesion at the interface, and this part is considered to become a portion where water is easy to enter in the transparent conductive member. In contrast, in the case of the transparent conductive material of the preset invention, the organic group in the reactive compound is bound to the conductive powder and this suppresses the increase of initial resistance. In addition, there is no free organic group on the surface of the conductive powder, different from the above, and it is thus feasible to adequately decrease portions where water is easy to enter in the transparent conductive member. The Inventors believe that this is one of factors to achieve the foregoing effect.

In the transparent conductive material, preferably, the reactive compound is a polymer compound having a weight-average molecular weight of not less than 10,000.

When the molecular weight of the reactive compound is within the above range, the number of functional groups in the molecule can be increased, when compared with the case where the reactive compound is a low-molecular compound, and it provides the effect of increase in crosslink density. As a result, it becomes feasible to obtain a transparent conductive member with well-controlled moisture permeability and excellent mechanical strength.

Preferably, the transparent conductive material further comprises an additive comprised of a monofunctional organic compound. In this case, it becomes feasible to obtain a transparent conductive member with smaller variation in resistance.

In the transparent conductive material, preferably the reactive compound further has a hydrophobic group in a molecule. When the reactive compound further has a hydrophobic group, it is feasible to obtain a transparent conductive member which water is unlikely to enter, by virtue of provision of hydrophobicity and steric hindrance.

In the transparent conductive material, preferably, the hydrophobic group is an aryl group or an alkyl group. When the hydrophobic group is an aryl group or an alkyl group, the hydrophobic group acts on spaces in a polymer network created by crosslinking originating from the reactive compound, to suppress intrusion of water by steric hindrance. In addition, the hydrophobic group is resistant to reception of water by virtue of hydrophobicity, whereby the resultant conductive member can suppress adhesion of water to the conductive powder more effectively.

In the transparent conductive material preferably, at least one of the reactive functional groups is a vinyl group. When at least one of the reactive functional groups is a vinyl group, it reacts with another functional group (vinyl group) to effect polymerization and crosslinking, thereby achieving improvements in mechanical strength and in water resistance. When it is an acryloyl group or a methacryloyl group being a derivative of the vinyl group, it becomes feasible to obtain a transparent conductive material with high transparency and excellent optical characteristics.

In the transparent conductive material, preferably, the organic group is one selected from the group costing of an alkoxysilane group and a silylamine group. The silylamine group encompasses groups derived from silylamine, and may have a substituent or the like.

When the foregoing organic group is one selected from the group consisting of an alkoxysilane group and a silylamine group, the conductive powder can be fixed more firmly to the reactive compound, as compared with the case where the organic group is a group except for the alkoxysilane group and the silylamine group. In other words, it is feasible to achieve excellent binding to the conductive powder.

In the transparent conductive material, preferably, the reactive compound further has a hydrophilic group selected from the group consisting of a carboxyl group, a hydroxyl group, an amino group, and an amine derivative group, in a molecule. Here the amine derivative group refers to a group derived from an amine.

When the reactive compound further has a hydrophilic group selected from the group consisting of a carboxyl group, a hydroxyl group, an amino group, and an amine derivative group, in the molecule, dispersion of the conductive powder is improved in the transparent conductive material containing the reactive compound having the hydrophilic group. In this case, a transparent conductive member with lower haze value can be obtained from this transparent conductive material, when compared with the transparent conductive materials wherein the conductive powder aggregates. In the transparent conductive material the conductive powder is uniformly dispersed and the contact area described later is increased between the crosslinked polymer and the conductive powder, whereby it becomes feasible to obtain a transparent conductive member more improved in total strength.

A transparent conductive member of the present invention is a transparent conductive member obtained by reacting a conductive powder, a reactive compound having an organic group capable of being bound to the conductive powder and a plurality of reactive functional groups; and a multifunctional organic compound capable of being bound to the reactive compound; so that the conductive powder is bound to the organic group and so that the reactive compound is bound to the multifunctional organic compound.

Here the transparent conductive member in the present invention encompasses those of film shape and plate shape; the transparent conductive member of film shape is defined as one having the thickness in the range of 50 nm to 1 mm, and the transparent conductive member of plate shape is defined as one having the thickness over 1 mm.

Since the transparent conductive member of the present invention is one obtained by reacting the conductive powder, the reactive compound, and the multifunctional organic compound so that the conductive powder is bound to the organic group and so that the reactive compound is bound to the multifunctional organic compound, the crosslinked polymer is obtained through binding between the reactive compound and the multifunctional organic compound and the conductive powder can be firmly bound to the crosslinked polymer. For this reason, it becomes feasible to obtain a transparent conductive member capable of adequately suppressing the increase and temporal change of electric resistance even if placed in the high humidity environment.

In the transparent conductive member, preferably, the reactive compound is a polymer compound having a weight-average molecular weight of not less than 10,000.

When the molecular weight of the reactive compound is within the above range, the number of functional groups in the molecule can be increased, when compared with the case where the reactive compound is a low-molecular compound, and it provides the effect of increase in crosslink density. As a result, it becomes feasible to obtain a transparent conductive member with well-controlled moisture permeability and excellent mechanical strength.

The transparent conductive member is preferably one obtained by reacting an additive comprised of a monofunctional organic compound, together with the conductive powder, the reactive compound, and the multifunctional compound. This transparent conductive member can have smaller variation in resistance.

In the transparent conductive member, preferably, the reactive compound further has a hydrophobic group in a molecule. When the reactive compound further has a hydrophobic group, it is feasible to obtain a transparent conductive member which water is unlikely to enter, by virtue of provision of hydrophobicity and steric hindrance.

In the transparent conductive member, preferably, the hydrophobic group is an aryl group or an alkyl group. When the hydrophobic group is an aryl group or an alkyl group, the hydrophobic group acts on spaces m a polymer network created by crosslinking originating from the reactive compound, to suppress intrusion of water by steric hindrance. In addition, the hydrophobic group is resistant to reception of water by virtue of hydrophobicity, whereby the resultant transparent conductive member can suppress adhesion of water to the conductive powder more effectively.

In the transparent conductive member, preferably, at least one of the reactive functional groups is a vinyl group. When at least one of the reactive functional groups is a vinyl group, it reacts with another functional group (vinyl group) to effect polymerization and crosslinking, thereby achieving improvements in mechanical strength and in water resistance. When it is an acryloyl group or a methacryloyl group being a derivative of the vinyl group, it becomes feasible to obtain a transparent conductive material with high transparency and excellent optical characteristics.

In the transparent conductive member, preferably, the organic group is one selected from the group coding of an alkoxysilane group and a silylamine group.

When the foregoing organic group is one selected from the group consisting of an alkoxysilane group and a silylamine group, the conductive powder can be fixed more firmly to the reactive compound, as compared with the case where the organic group is a group except for the alkoxysilane group and the silylamine group. In other words, it is feasible to achieve excellent binding to the conductive powder.

In the transparent conductive member, preferably, the reactive compound further has a hydrophilic group selected from the group consisting of a carboxyl group, a hydroxyl group, an amino group, and an amine derivative group, in a molecule.

When the reactive compound further has a hydrophilic group selected from the group consisting of a carboxyl group, a hydroxyl group, an amino group, and an amine derivative group, in the molecule, dispersion of the conductive powder is improved in the transparent conductive material containing the reactive compound having the hydrophilic group. In this case, a transparent conductive member with lower haze value can be obtained from this transparent conductive material, when compared with the transparent conductive materials wherein the conductive powder aggregates. In the transparent conductive material, the conductive powder is uniformly dispersed and the contact area described later is increased between the crosslinked polymer and the conductive powder, whereby it becomes feasible to obtain a transparent conductive member more improved in total strength.

DESCRIPTION OF THE PREFERRED EMBODIMENTS

Figure 1:
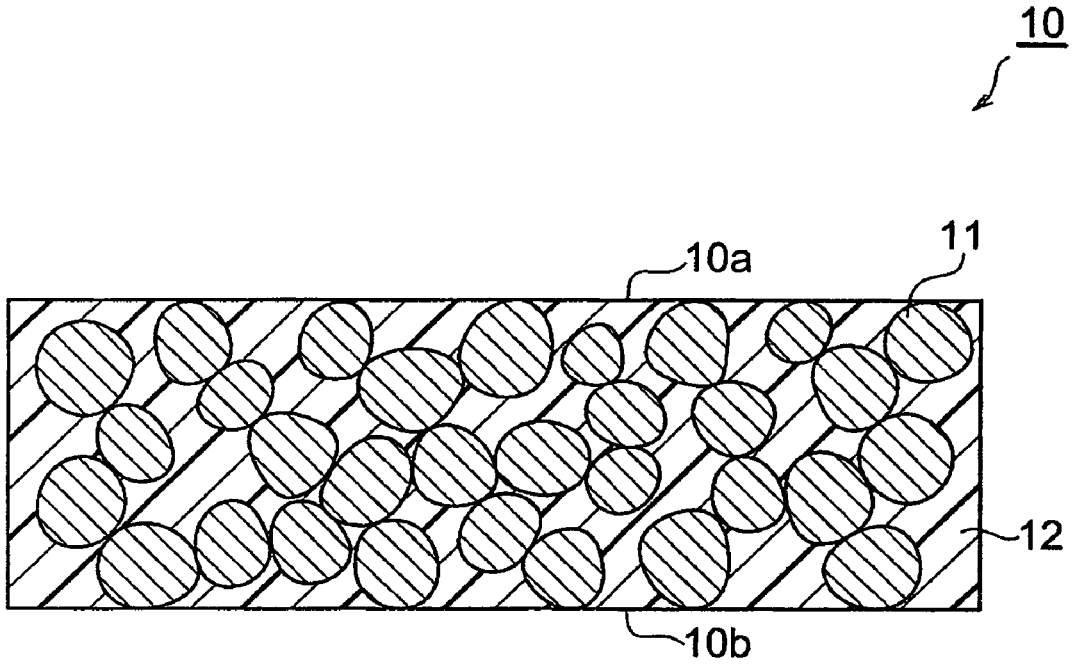
FIG. 1 is a schematic sectional view showing the first embodiment of the transparent conductive member of the present invention.

Preferred embodiments of the present invention will be described below in detail with reference to the drawings according to need. Identical elements will be denoted by the same reference symbols in the drawings, without redundant description. It is also noted that dimensional ratios in the drawings are not always limited to those illustrated.

First Embodiment of Transparent Conductive Member

First, the first embodiment of the transparent conductive member of the present invention will be described.

FIG. 1 is a schematic sectional view showing the first embodiment of the transparent conductive member of the present invention. As shown in FIG. 1, the transparent conductive member 10 of the present embodiment has conductive powder 11 and crosslinked polymer 12. The conductive powder 11 is filled in the transparent conductive member 10 and the conductive powder 11 is fixed to the crosslinked polymer 12.

In the transparent conductive member 10, particles of conductive powder 11 are preferably in contact with each other and the conductive powder 11 is exposed in part in surface 10*a* or 10*b* of transparent conductive member 10. For this reason, the transparent conductive member 10 can have sufficient electric conductivity.

The transparent conductive member 10 can adequately suppress the increase and temporal change of electric resistance even if placed in a high humidity environment. The mechanism enabling the adequate suppression of the increase and temporal change of electric resistance in the conductive member 10 as described above is still incompletely understood, but the Inventors believe that in the transparent conductive member 10 containing the conductive powder 11 and the crosslinked polymer 12, the crosslinked polymer 12 fills the spaces between particles of conductive powder 11 scattered in the transparent conductive member 10, to fully prevent swelling of the crosslinked polymer 12 even in the high humidity environment, so as to adequately prevent the disjunction between particles of conductive powder 11 and to adequately prevent the increase and temporal change of electric resistance of the transparent conductive member 10.

In addition, where conductive powder 11 having or organic groups in its surface is reacted with a reactive compound and a multifunctional organic compound having no organic group, a dielectric layer is preliminarily formed on the surface of the conductive powder and the initial resistance tends to be high. In addition, there remain many free organic groups not reacting with the reactive compound on the surface of conductive powder 11, so as to degrade adhesion at this interface, and this part is considered to be a portion where water is easy to enter in the transparent conductive member 10. In contrast, in the case of the transparent conductive material of the present invention, the organic group in the reactive compound is bound to the conductive powder 11, to suppress the increase of initial resistance. Furthermore, there exist no free organic groups on the surface of conductive powder 11, different from the above, and it is thus feasible to fully reduce portions where water is likely to enter in the transparent conductive member 10. The Inventors believe that this is one of factors to achieve the aforementioned effect.

In the transparent conductive member 10, preferably, the crosslinked polymer 12 has at least one hydrophobic group selected from the group consisting of an aryl group and an alkyl group. When the crosslinked polymer 12 has the hydrophobic group, the moisture permeability of the crosslinked polymer is lowered by hydrophobicity and steric hindrance between molecules of the crosslinked polymer 12, whereby the swelling of crosslinked polymer 12 can be suppressed more effectively.

A production method of the transparent conductive member 10 win be described below.

The transparent conductive member 10 can be made of a tangent conductive material.

(Transparent Conductive Material)

The transparent conductive material contains a conductive powder 11, a reactive compound having an organic group capable of being bound to the conductive powder 11 and a plurality of reactive functional groups, and a multifunctional organic compound capable of being bound to the reactive compound.

With use of the transparent conductive material, it becomes feasible to increase the strength of crosslinked polymer 12 obtained by reaction between the reactive compound ad the multifunctional organic compound. In addition, it becomes feasible to firmly bind the conductive powder 11 to the crosslinked polymer 12. Therefore, this transparent conductive material makes it feasible to obtain the transparent conductive member 10 capable of adequately preventing the swelling of the crosslinked polymer 12 even with intrusion of water and more effectively suppressing the increase and temporal change of electric resistance even in the high humidity environment.

(Reactive Compound)

The reactive compound is preferably a polymer compound having the weight-average molecular weight of not less than 10,000. The number of functional groups in the molecule can be increased, when compared with the case where the reactive compound is a low-molecular compound, and its effect is an improvement in crosslink density. As a result it is feasible to obtain a transparent conductive member with well-controlled moisture permeability and excellent mechanical strength. The weight-average molecular weight is more preferably not more than 1,000,000. If the weight-average molecular weight exceeds 1,000,000, the solubility in liquid will be inadequate, and the compound will tend to become difficult to handle and decrease the moisture reactive of the hardened material.

The structure of the reactive compound in this case is a linear structure or a branched structure and, more specifically, it is a structure in which a linear structure becoming a main chain is modified by plural types of reactive functional groups, or a structure in which the main chain and side chains branched from the main chain are modified by plural types of reactive functional groups.

The polymer compound to be used can be one arbitrarily selected from commonly available polymer compounds including acrylic resin such as polymethyl methacrylate, polyester, polycarbonate, polyurethane, polyether, polystyrene, polyolefin, polyaniline, or derivatives thereof, polypyrrole or derivatives thereof, polyphenyl or derivatives thereof polythiophene or derivatives thereof, polyacrylamide, polyvinyl alcohol and so on. Among these, the acrylic resin is particularly preferably used in terms of optical transparency, non discoloring nature, scratch resistance, and so on.

The reactive compound has a plurality of reactive functional groups. The plurality of reactive functional groups may be mutually identical groups, or different types of groups.

There are no specific restrictions on the types of reactive functional groups of the reactive compound according to the present embodiment as long as the number of reactive functional groups is two or more the number of types is preferably 2 to 4. If the types of reactive functional groups are more than four, they could cause degradation of storage stability of the reactive compound and decrease of crosslink density of the crosslinked polymer 12, when compared with the case where the types of reactive functional groups are four or less.

The reactive functional groups can be functional groups (e.g., vinyl groups or the like) polymerizable with functional groups of the same kind, or functional groups (e.g., hydroxyl groups, epoxy groups, etc.) polymerizable with functional groups of different kinds. The polymerization can be achieved by any method making use of light, heat, a catalyst, an initiator, or the like.

Among those, photopolymerization (including polymerization with a photopolymerization initiator) is preferred. When the reactive compound possesses photopolymerizability, the curing reaction can be controlled and the curing can be accomplished within a short required time, thereby providing the advantage of simplification of process management.

Alternatively, the reactive functional groups are preferably reactive double bond (polymerizable double bond) groups though there are no particular restrictions thereon. More preferably, the reactive double bond groups are vinyl groups. When the plurality of reactive functional groups have at least one vinyl group, since the molecular weight of the reactive compound is not less than 10,000, the molecule weight after cured is not less than 10,000, and it provides the advantage that the moisture resistance and mechanical strength of the crosslinked polymer 12 can be maintained over a specific level. Furthermore, an increase of the content of vinyl groups in the polymer compound can increase the crosslink density, whereby the crosslinked polymer 12 can be obtained with better endurance. The vinyl group stated herein also embraces a group derived from a vinyl group and may have a substituent or the like. Examples of such groups include groups having a polymerizable double bond, such as an acryloyl group, a methacryloyl group, and a styrene group.

There are no particular restrictions on the content of vinyl groups or the like in the reactive compound, but an average number of reactive groups in one molecule of the reactive compound is preferably 2-50 and more preferably 5-20, based on vinyl groups per molecular weight of 10,000. If it is less than 2, the reactive compound cannot be sufficiently crosslinked, when compared with the case where the average number is not less than 2. Therefore, it will result in low crosslink density of the crosslinked polymer containing the reactive compound. If the average number exceeds 50, the molecular weight of the main chain or side chde chains of the reactive compound will decrease, which will supposedly cause adverse effects such as decrease of crosslink density due to influence of steric hindrance or the like, failure in sufficient modification of the other functional groups of the reactive compound, and so on.

The reactive compound has an organic group. The organic group has a binding function to the conductive powder 11. This organic group is one selected from an or conductive silane group, an organic aluminum group, an organic titanium group, and an organic phosphorus group. Among these, the organic silane group can be suitably used. Specifically, the organic group is more preferably a group selected from the group consisting of an alkoxysilane group and a silylamine group which are organic silane groups. The reactive compound having these groups can fix the conductive powder 11 to the reactive compound more firmly than in the case where the reactive functional group is an organic group except for the alkoxysilane group, the silylamine group, and derivatives of the silylamine group. In other words, the reactive compound can have excellent binding nature to the conductive powder. Since the alkoxysilane group promotes the reaction by heat, the binding nature can be further enhanced by execution of a thermal treatment.

There are no particular restrictions on the content of the alkoxysilane group or the like in the reactive compound, but an average number of reactive groups in one molecule of the reactive compound is preferably 2-20 and more preferably 5-10, based on triethoxy silane groups per molecular weight of 10,000. If the average number is less than 2, sufficient binding cannot be secured between the reactive compound and the conductive powder. If the average number exceeds 20, the storage stability of the reactive compound will degrade, and the reactive compound could not be used because of gelation or deterioration.

Since the reactive compound has a plurality of functional groups with different functions in the molecule, it becomes feasible to form a functional structure.

In another preferred configuration, the reactive compound contains a hydrophilic group selected from the group consisting of a carboxyl group, a hydroxyl group, an amino group, and an amine derivative group, as a functional group except for the reactive functional groups. In the transparent conductive material containing the reactive compound having one of these hydrophilic groups, the dispersibility of conductive powder 11 is improved. For this reason, the resistance and haze value are decreased in the transparent conductive member 10 made of the transparent conductive material wherein the hydrophilic group is a group selected from a carboxyl group, a hydroxyl group, an amino group, and an amine derivative group, when compared with the transparent conductive materials wherein the conductive powder 11 aggregates. As the conductive powder 11 is uniformly dispersed, the contact area is increased between the crosslinked polymer 12 and the conductive powder 11 and the total strength of the transparent conductive member 10 is also more increased.

Furthermore, the reactive compound preferably has a hydrophobic group in the molecule. In this case, where the transparent conductive member 10 is formed, it becomes feasible to obtain the transparent conductive member 10 that adequately prevents intrusion of water into the crosslinked polymer 12 obtained by reaction between the reactive compound and the multifunctional organic compound and that adequately prevents variation of resistance.

The hydrophobic group is, for example, an aryl group such as a phenyl group or a naphthyl group, or, for example, an alkyl group such as a methyl group, an ethyl group, a propyl group, an isopropyl group, a butyl group, a tertiary butyl group, a lauryl group, a stearyl group, or a behenyl group. When the terminal group is the foregoing aryl group or alkyl group, the swelling of the crosslinked polymer 12 can be suppressed more effectively by water diffusion preventing action based on hydrophobicity of the reactive compound and formation of steric hindrance between molecules.

(Multifunctional Organic Compound)

The multifunctional organic compound is a compound in which two or more reactive functional groups exist in a molecule, and there are no particular restrictions on the compound if it can form the crosslinked polymer 12. The multifunctional organic compound may be one binding to the reactive compound to form the crosslinked polymer 12, or one not binding to the reactive compound.

The multifunctional organic compound can be polyethylene glycol diacrylate, tetramethylol methane tetraacrylate, or the like, for example, where the aforementioned reactive compound has a vinyl group, an acryloyl group, a methacryloyl group, or the like. These multifunctional organic compounds undergo polymerization with the aforementioned reactive compound, another multifunctional organic compound, or the like. In another configuration, the multifunctional organic compound contains two or more functional groups in a molecule, whereby another functional group also contributes to the polymerization; therefore, the crosslinking reaction proceeds securely to form the crosslinked polymer 12.

On the other hand, where the reactive compound has a vinyl group or the like, a group not binding to these functional groups is, for example, an epoxy group. In this case, the epoxy group does not bind to the vinyl group, but polymerization proceeds between epoxy groups to form a complex crosslinked structure of acrylic resin and epoxy resin. Where the multifunctional organic compound has a vinyl group and an epoxy group, a crosslinked copolymer of acrylic resin and epoxy resin is formed.

(Conductive Powder)

The conductive powder 11 is comprised of a transparent conductive oxide material. There are no particular restrictions on the transparent conductive oxide material as long as it has transparency and electric conductivity. The transparent conductive oxide material can be, for example, indium oxide, or indium oxide doped with at least one element selected from the group consisting of tin, zinc, tellurium, silver, gallium, zirconium, hafnium and magnesium; tin oxide, or tin oxide doped with at least one element selected from the group consisting of antimony, zinc, and fluorine; zinc oxide, or zinc oxide doped with at least one element selected from the group consisting of aluminum, gallium, indium, boron, fluorine, and manganese.

The conductive powder 11 is preferably a waterproof conductive powder. Here the "waterproof conductive powder" refers to a conductive powder free of deterioration with water, such as increase of resistance. Specifically, the waterproof conductive powder differs depending upon the foregoing transparent conductive oxide material. Namely, where the transparent conductive oxide material is indium oxide, or an indium complex oxide in which indium oxide is doped with at least one element selected from the group consisting of tin, zinc, tellurium, silver, gallium, zirconium, hafnium, and magnesium, the waterproof conductive powder can be a mixed solution containing 1% by mass of conductive powder and having pH of not less than 3, or a mixed solution containing 1% by mass of conductive powder, having pH of less than 3, and having the halogen concentration of not more than 0.2% by mass. Where the transparent conductive oxide material is tin oxide, or a tin complex oxide in which tin oxide is doped with at least one element selected from the group consisting of antimony, zinc, and fluorine, the waterproof conductive powder is a mixed solution containing 1% by mass of conductive powder, having pH of not less than 1, and having the halogen concentration of not more than 1.5% by mass. Where the transparent conductive oxide material is zinc oxide, or a zinc complex oxide in which zinc oxide is doped with at least one element selected from the group consisting of aluminum, gallium, indium, boron, fluorine, and manganese, the waterproof conductive powder can be a mixed solution containing 1% by mass of conductive powder and having pH of 4-9. The "mixed solution" refers to a solution consisting of water and conductive powder.

With use of the conductive powder 11 as described above, the transparent conductive member 10 containing the waterproof conductive powder 11 and the crosslinked polymer 12 can more effectively prevent the temporal change of resistance even in the high humidity environment.

Adjustment of pH of the mixed solution containing 1% by mass of the conductive powder can be performed by desorption of impurities or the like, for example, based on washing with water, neutralization, or heating, and it is preferably implemented by neutralization, particularly, by neutralization with ammonia water. By using this method, it is feasible to readily control pH of the mixed solution, and to selectively elute chlorine from the conductive powder to effectively reduce the chlorine concentration in the conductive powder.

The average particle size of the conductive powder 11 is preferably 10 nm-80 nm. If the average particle size is less hand 10 nm, the electric conductivity of the transparent conductive member 10 tends to become less stable than in the case where the average particle size is not less than 10 nm. Namely, the transparent conductive material according to the present embodiment exhibits the electric conductivity by virtue of oxygen defects in the conductive powder 11, and, where the particle size of conductive powder 11 is less than 10 nm, the oxygen defects will decrease, for example, if the external oxygen concentration is high. This could result in variation of electric conductivity. On the other hand, if the average particle size exceeds 80 nm, optical scattering will increase, for example, in the wavelength region of visible light, when compared with the case where the average particle size is not more than 80 nm. In addition, the transmittance of transparent conductive member 10 will decrease in the wavelength region of visible light and the haze value will tend to increase.

The specific surface area of the conducive powder 11 is preferably 10-50 $m^2/g$. If the specific surface area is less than 10 $m^2/g$, the optical scattering of visible light will tend to increase. If the specific surface area exceeds 50 $m^2/g$, the stability of the transparent conductive material will tend to degrade. The specific surface area stated herein is a value measured after vacuum dying of a sample at 300° C. for 30 minutes, with an automatic surface area analyze (model: NOVA2000, available from Quantachrome Instruments).

The content of the conductive powder 11 in the material forming the transparent conductive member 10 is preferably 10% by volume to 70% by volume. If the content is less than 10% by volume the resistance of transparent conductive member 10 will tend to be high. If the content exceeds 70% by volume, the mechanical strength of transparent conductive member 10 will tend to degrade.

The conductive powder 11 can be produced as follows. An example of the conductive powder 11 adopted herein is one in which indium oxide is doped with tin (hereinafter referred to as "ITO").

First, indium chloride and tin chloride are coprecipitated by neutralization with alkali (precipitation step). A by-product salt produced at this time is removed by decantation or centrifugal separation. The resultant coprecipitate is dried and the resultant dried body is subjected to processes of atmospheric baking and pulverization. The conductive powder is produced in this manner. The baking process is preferably carried out in a nitrogen atmosphere, or in a rare gas atmosphere of helium, argon, xenon, or the lie in terms of control of oxygen defects.

(Other Component)

The transparent conductive material preferably contains an additive comprised of a monofunctional organic compound, in addition to the above-described reactive compound, multifunctional organic compound, and conductive powder 11. In this case, it becomes feasible to obtain the transparent conductive member 10 with smaller variation of resistance. Here the functional group in the monofunctional organic compound is one properly selected for complementing the function necessary for the crosslinked polymer 12, and is one for imparting moisture resistance in the present invention. The functional group of this type is, for example, an aryl group, an alkyl group, or the like. Among these, the functional group is preferably a methyl group, an ethyl group, a propyl group, an isopropyl group, a butyl group, a tertiary butyl group, a lauryl group, a stearyl group, a behenyl group, a phenyl group, or a naphthyl group. A specific example of the above additive is, for example, phenoxy polyethylene glycol acrylate.

The transparent conductive member 10 can be produced as described below.

First, the transparent conductive material containing the conductive powder 11, the reactive compound, the multifunctional organic compound, and a polymerization initiator is dispersed in a liquid to obtain a dispersion liquid. The liquid for dispersion of the transparent conductive material can be one selected from saturated hydrocarbons such as hexane, aromatic hydrocarbons such as toluene and xylene, ketones such as acetone, methyl ethyl ketone, isobutyl methyl ketone, and diisobutyl ketone, esters such as ethyl acetate and butyl acetate, ethers such as tetrahydrofuran, dioxane, and diethyl ether, and amides such as N,N-dimethylacetamide, N,N-dimethylformamide, and N-methylpyrrolidone.

Next, the above dispersion liquid is applied onto one surface of a substrate. The application of the dispersion liquid onto the substrate can be one of the known methods without any particular restrictions. For example, applicable methods include the reverse roll method, the direct roll method, the blade method, the knife method, the extrusion method, the nozzle method, the curtain method, the gravure roll method, the bar coat method, the dip method, the kiss coat method, the spin coat method, the squeeze method, and the spray method.

Where the polymerization initiator in the dispersion liquid is a thermal polymerization initiator, the coating is dried and then heated to a temperature above the polymerization initiation temperate of the thermal polymerization initiator to effect curing. This results in obtaining the transparent conductive member 10 on one surface of the substrate.

When the polymerization initiator in the dispersion liquid is a photopolymerization initiator, the coating is dried and then exposed to light to be cured. In this manner the transparent conductive member 10 is formed on one surface of the substrate.

The transparent conductive member 10 obtained in this manner can be suitably used in antinoise components, beat generating members, EL electrodes, backlight electrodes, touch panels, and so on.

Second Embodiment of Transparent Conductive Member

Next, the second embodiment of the transparent conductive member of the present invention will be described. Identical or equivalent components to those in the first embodiment will be denoted by the same reference symbols, without redundant description.

Figure 2:
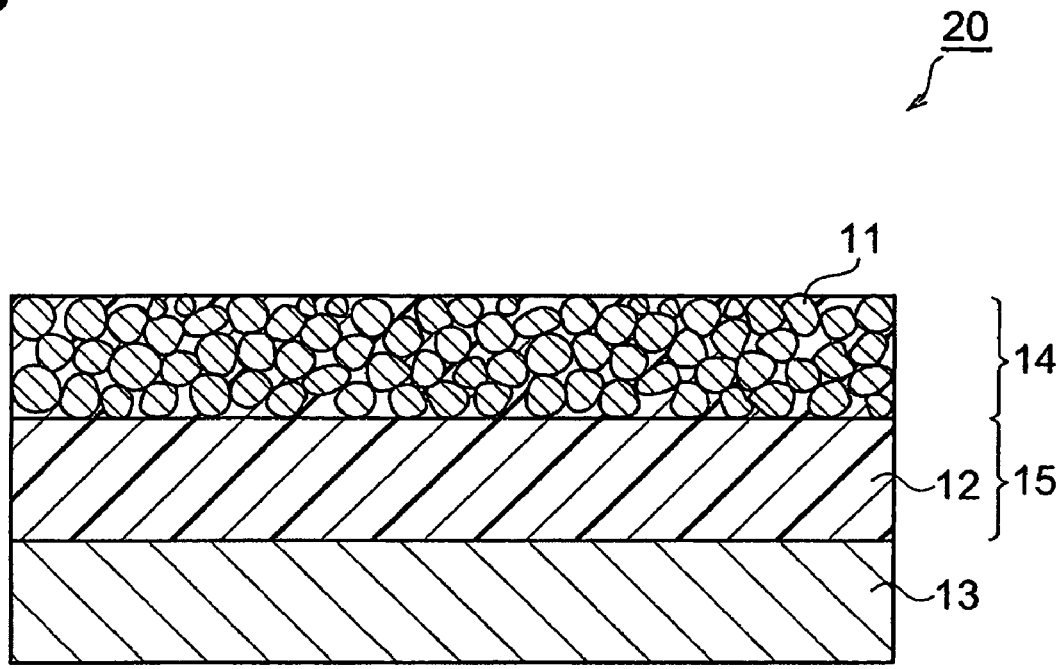
FIG. 2 is a schematic sectional view showing the second embodiment of the transparent conductive member of the present invention.

FIG. 2 is a schematic sectional view showing the second embodiment of the transparent conductive member of the present invention. As shown in FIG. 2, the transparent conductive member 20 of the present embodiment is comprised of a transparent conductive layer 14 containing a conductive powder 11, a crosslinked polymer layer 15 comprised of a crosslinked polymer 12, and a support 13, and the crosslinked polymer layer 15 and transparent conductive layer 14 are successively layered on the support 13. The transparent conductive layer 14 is filled with the conductive powder 11, and the crosslinked polymer 12 having penetrated exists between particles of conductive powder 11. The crosslinked polymer 12 fixes the conductive powder 11.

The transparent conductive member 20 can adequately suppress the increase and temporal change of electric resistance in the transparent conductive member 20 even if placed in a high humidity environment.

There are no particular restrictions on the support 13 if it is made of a transparent material to a high energy beam described later and visible light. It may be a known transparent film. Namely, the sort 13 can be, for example, a polyester film of polyethylene terephthalate (PET) or the like, a polyolefin film of polyethylene, polypropylene, or the like, a polycarbonate film, an acrylic film, a norbornene film (ARTON available from JSR K. K., or the like), or the like. The support can also be a glass sheet, instead of the resin films.

The transparent conductive member 20 can be produced, for example, as described below. Namely, the conductive powder 11 is first placed on an unrepresented substrate. In this case, it is preferable to preliminarily provide an anchor layer fixing the conductive powder onto the substrate, on the substrate. When the anchor layer is preliminarily provided, the conductive powder 11 can be firmly fixed on the substrate. It also facilitates placing the conductive powder 11. The anchor layer can be preferably polyurethane or the like, for example.

For fixing the conductive powder on the substrate, the conductive powder 11 may be compressed toward the substrate to form a compressed layer. In this case, the conductive powder 11 can be bonded to the substrate without formation of the anchor layer, which is useful. This compression can be performed by sheet press, roll press, or the like. In this case, it is also preferable to preliminarily provide the anchor layer on the substrate. In this case, it is feasible to fix the conductive powder 11 more firmly.

The substrate can be, for example, a film of polyester, polyethylene, polypropylene, or the like, one of various plastic substrates, or the like, in addition to glass.

Next, the aforementioned first form of the transparent conductive material without the conducive powder (hereinafter simply referred to as "non-conductive material") is applied onto one surface of the compressed layer. At this time, part of the non-conductive material penetrates into the compressed layer.

Then the support 13 is provided on the non-conductive material. The non-conductive material is one that can be cured with a high energy beam described later.

The non-conductive material is exposed to the high energy beam in FIG. 2 to react the reactive compound with the multifunctional organic compound in the non-conductive material to obtain the crosslinked polymer 12. This results in forming the crosslinked polymer 12 penetrating into the conductive powder 11 and being cured, and thereby fixing the conductive powder 11 to form the transparent conductive layer 14. The material not penetrating into the conductive powder 11 is hardened as it is, to form the crosslinked polymer layer 15. At this time, the support 13 is further bonded to the crosslinked polymer layer 15.

The high energy beam described above may be, for example, light such as ultraviolet light, or may be an electron beam, a γ-beam, an X-ray, or the like.

By this exposure to the high energy beam, the non-conductive material is cured to form each of the layers. Thereafter, the substrate is peeled off to obtain the transparent conductive member 20 shown in FIG. 2.

The content of the conductive powder 11 in the material forming the transparent conductive layer 14 according to the present embodiment is preferably 10% by volume to 70% by volume. If the content is less than 10% by volume, the resistance of the transparent conductive member will tend to become high. If the content exceeds 70% by volume, the mechanical strength of the transparent conductive layer 14 will tend to decrease.

The above described the preferred embodiments of the present invention, but it is noted that the present invention is by no means intended to be limited to the above embodiments.

For example, the transparent conductive material of the present invention may contain a flame retardant an ultraviolet absorber, a coloring agent, a plasticizer, or the like as occasion may demand.

The transparent conductive material of the present invention may further contain a viscosity increasing agent such as acrylic resin. In this case, the transparent conductive material can function as a transparent conductive paste. The transparent conductive paste can adequately prevent the teal change of electric resistance even in the high humidity environment. Since the transparent conductive paste has constant viscosity, it can be uniformly delivered on the occasion of delivering it onto the substrate, and it can be readily delivered even onto a narrow part or an uneven part. This transparent conductive paste can be obtained by adding the viscosity increasing agent, such as acrylic resin, into the aforementioned dispersion liquid and drying it.

In the above description of the production method of the transparent conductive member 20, the transparent conductive material was the one that can be cued with the high energy beam, but it may be replaced by one containing a material that can be cured by heat.

In the transparent conductive member 20 the part without the conductive powder 11 in the transparent conductive layer 14, and the crosslinked polymer layer 15 were made of the transparent conductive material of the first form without the conductive powder, but may be made of the transparent conductive material of the second form without the conductive powder.

EXAMPLES

The present invention will be fiber specifically described below with examples thereof, but it is noted that the present invention is by no means intended to be limited to these examples.

(Preparation of Conductive Powder)

19.9 g of indium chloride tetrahydrate (available from Kanto Chemical Co., Inc.) and 2.6 g of stannic chloride (available from Kanto Chemical Co., Inc.) were dissolved in 980 g of water to obtain an aqueous solution, and the aqueous solution was mixed with ammonia water (available from to Chemical Co., Inc.) diluted with ten-fold water, thereby producing a white precipitate (coprecipitate).

The liquid containing the precipitate thus produced was subject to solid-liquid separation with a centrifugal separator, thereby obtaining a solid product. This was further put in 1000 g of water to be dispersed with a homogenizer, and the liquid was subjected to solid-liquid separation with a centrifugal separator. The dispersion and solid-liquid separation were repeated five times, and the solid material was dried and heated at 600° C. in a nitrogen atmosphere for one hour to obtain ITO powder (conductive powder). A mixed solution was prepared from this ITO powder and water. At this time the content of the conductive powder in the mixed solution was adjusted to 1% by mass. Then pH of the mixed solution was measured with a pH meter, and the pH of the mixed solution was 3.0. Chlorine was below a detection limit.

Example 1

A transparent conductive material of paste form was prepared by mixing 17.75 g of the above ITO powder (conductive powder), 3 g of phenoxy polyethylene glycol acrylate (additive, available from Shin-Nakamura Chemical Co., Ltd), 6 g of an acrylic polymer (reactive compound having the average molecular weight of about 50,000, and containing 50 vinyl groups (reactive functional groups) on average and 25 groups of triethoxy silane (organic groups) on average), 3 g of A-TMMT (multifunctional organic compound, available from Shin-Nakamura Chemical Co., Ltd.), 30 g of acetone (available from Kanto Chemical Co., Inc.), and 0.24 g of a UV polymerization initiator (Ciba Specialty Chemicals) and dispersing them with a homogenizer. This transparent conductive material was applied onto a 50 mm-square glass substrate by spin coating, acetone was then removed, and the material was exposed to UV light (at the intensity of 160 W/cm) emitted from a high-pressure mercury lamp in a nitrogen atmosphere. Furthermore, the material was subjected to a heat treatment at 120° C. for one hour, thereby obtaining a transparent conductive film.

Example 2

A transparent conductive film was obtained in the same manner as in Example 1 except that no additive was added and the amount of A-TMMT added was changed to 6 g.

Example 3

A transparent conductive film was obtained in the same manner as in Example 1 except that the average molecular weight of the reactive compound was about 10,000, the vinyl groups were two groups on average, and the groups of triethoxy silane were five groups on average.

Example 4

A transparent conductive film was obtained in the same manner as in Example 1 except that the average molecular weight of the reactive compound was about 80,000, the vinyl groups were 80 groups on average ad the groups of triethoxy silane were 60 groups on average.

Example 5

A transparent conductive film was obtained in the same manner as in Example 1 except that the multifunctional organic compound was changed to tetraethylene glycol diacrylate.

Example 6

A transparent conductive film was obtained in the same manner as in Example 1 except that the additive was changed to stearyl acrylate.

Example 7

A transparent conductive film was obtained in the same manner as in Example 1 except that the average molecular weight of the reactive compound was about 10,000, the vinyl groups were ten grows on average, and the groups of triethoxy silane were two groups on average.

Comparative Example 1

A transparent conductive film was obtained in the same manner as in Example 1 except that the reactive compound and the multifunctional organic compound were not added and the additive was changed to 12 g of methyl methacrylate.

Comparative Example 2

A transparent conductive film was obtained in the same manner as in Example 1 except that the average molecular weight of the reactive compound was about 50,000, the vinyl groups were 50 groups on average, the added amount was changed to 6 g, and the multifunctional organic compound and the additive were changed to 6 g of methyl methacrylate.

Comparative Example 3

A transparent conductive film was obtained in the same manner as in Example 1 except that the multifunctional organic compound was not added and the reactive compound and the additive were added each by 6 g.

Comparative Example 4

A transparent conductive film was obtained in the same manner as in Example 1 except that the reactive compound was not added and the additive and the multifunctional organic compound were added each by 6 g.

[Evaluation Method]

Evaluation of Resistance of Transparent Conductive Film

The electric resistance was evaluated as described below, for each of the transparent conductive films obtained as described above. Specifically, values of electric resistance were measured at predetermined measurement points on each of the transparent conductive films obtained as described above, with a 4-terminal 4-probe surface resistivity meter (MCP-T600 available to Mitsubishi Chemical), and the measured values were defined as initial electric resistances. Thereafter, the transparent conductive films were placed in an environment of 60° C. and 95% RH for 1000 hours, and they were taken out. When the transparent conductive films reached room temperature, values of electric resistance were again measured at the measurement points defined before humidification, and those values were defined as electric resistances after humidification. Then a change rate was calculated according to the following equation:

change rate=electric resistance after humidification/initial electric resistance.

The results are presented in Table 1.

TABLE 1

| | Initial electric resistance kΩ/□ | Electric resistance after humidification kΩ/□ | Change rate of resistance times |
|---|---|---|---|
| Example 1 | 3.254 | 3.579 | 1.10 |
| Example 2 | 3.587 | 4.161 | 1.16 |
| Example 3 | 2.976 | 3.720 | 1.25 |
| Example 4 | 3.471 | 3.645 | 1.05 |
| Example 5 | 3.611 | 4.225 | 1.17 |
| Example 6 | 4.631 | 5.279 | 1.14 |
| Example 7 | 4.035 | 4.882 | 1.21 |
| Comparative Example 1 | 3.264 | 87.22 | 26.72 |
| Comparative Example 2 | 3.595 | 25.16 | 7.00 |
| Comparative Example 3 | 3.719 | 14.06 | 3.78 |
| Comparative Example 4 | 3.148 | 10.67 | 3.39 |

As apparent from Table 1, it was found that Examples 1-7 demonstrated smaller changes of electric resistance than Comparative Examples 1-4 and thus the increase of electric resistance was adequately suppressed. The above results confirmed that the transparent conductive materials of the present invention were able to adequately suppress the increase and temporal change of electric resistance even in the high humidity environment.

The present invention successfully provides the transparent conductive material and the transparent conductive member capable of adequately suppressing the increase and temporal change of electric resistance in the transparent conductive member even in the high humidity environment.

What is claimed is:

1. A transparent conductive material comprising:

a conductive powder;

a reactive compound having a plurality of organic groups capable of being bound to the conductive powder and a plurality of reactive functional groups; and a multifunctional organic compound capable of being bound to the reactive compound, wherein each of the organic groups is one selected from an organic silane group, an organic aluminum group, an organic titanium group, and an organic phosphorus group; and wherein the reactive compound is a polymer compound having a weight-average molecular weight of not less than 10,000.

2. The transparent conductive material according to claim 1, further comprising an additive comprised of a monofunctional organic compound.

3. The transparent conductive material according to claim 1, wherein the reactive compound further has a hydrophobic group in a molecule.

4. The transparent conductive material according to claim 3, wherein the hydrophobic group is an aryl group or an alkyl group.

5. The transparent conductive material according to claim 1, wherein at least one of the reactive functional groups is a vinyl group.

6. The transparent conductive material according to claim 1, wherein the organic group is one selected from the group consisting of an alkoxysilane group and a silylamine group.

7. The transparent conductive material according to claim 1, wherein the reactive compound further has a hydrophilic group selected from the group consisting of a carboxyl group, a hydroxyl group, an amino group, and an amine derivative group, in a molecule.

8. A transparent conductive member obtained by reacting a conductive powder; a reactive compound having a plurality of organic groups capable of being bound to the conductive powder and a plurality of reactive functional groups; and a multifunctional organic compound capable of being bound to the reactive compound; where the conductive powder is bound to the organic group and where the reactive compound is bound to the multifunctional organiccompound, wherein each of the organic groups is one selected from an organic silane group, an organic aluminum group, an organic titanium group, and an organic phosphorus group, and wherein the reactive compound is a polymer compound having a weight-average molecular weight of not less than 10,000.

9. The transparent conductive member according to claim 8, which is obtained by reacting an additive comprised of a monofunctional organic compound, together with the conductive powder, the reactive compound, and the multifunctional compound.

10. The transparent conductive member according to claim 8, wherein the reactive compound further has a hydrophobic group in a molecule.

11. The transparent conductive member according to claim 10, wherein the hydrophobic group is an aryl group or an alkyl group.

12. The transparent conductive member according to claim 8, wherein at least one of the reactive functional groups is a vinyl group.

13. The transparent conductive member according to claim 8, wherein the organic group is one selected from the group consisting of an alkoxysilane group and a silylamine group.

14. The transparent conductive member according to claim 8, wherein the reactive compound further has a hydrophilic group selected from the group consisting of a carboxyl group, a hydroxyl group, an amino group, and an amine derivative group, in a molecule.

* * * * *